US011944207B2

(12) United States Patent
Ali

(10) Patent No.: US 11,944,207 B2
(45) Date of Patent: Apr. 2, 2024

(54) VEHICLE BUCKET SEAT ADAPTER FOR ALTERNATIVE USE/UTILITY

(71) Applicant: Shurjo Ali, Plano, TX (US)

(72) Inventor: Shurjo Ali, Plano, TX (US)

( * ) Notice: Subject to any disclaimer, the term of this patent is extended or adjusted under 35 U.S.C. 154(b) by 1 day.

(21) Appl. No.: 17/851,888

(22) Filed: Jun. 28, 2022

(65) Prior Publication Data

US 2023/0009975 A1 Jan. 12, 2023

Related U.S. Application Data

(60) Provisional application No. 63/219,830, filed on Jul. 9, 2021.

(51) Int. Cl.

| | |
|---|---|
| ***A47C 13/00*** | (2006.01) |
| ***A47C 4/02*** | (2006.01) |
| ***A47C 7/00*** | (2006.01) |

(52) U.S. Cl.

CPC ..... *A47C 7/004* (2013.01); *A47C 4/02* (2013.01); *A47C 13/00* (2013.01)

(58) Field of Classification Search

CPC ..... A47C 7/004; A47C 13/00; A47C 4/02
USPC ..... 297/118, 130, 344.21–344.26, 440.22
See application file for complete search history.

(56) References Cited

U.S. PATENT DOCUMENTS

| | | | | |
|---|---|---|---|---|
| 8,695,932 | B1 * | 4/2014 | Balsis, III | B60N 2/015 297/130 |
| 2003/0122407 | A1 * | 7/2003 | Boyd | B60N 2/80 297/440.22 |
| 2009/0127908 | A1 * | 5/2009 | Kucharski | B60N 2/14 297/344.24 |

OTHER PUBLICATIONS

"Turn an Old Car Seat Into a New Office Chair"—Tom Suddard; Mar. 27, 2021 | DIY, tech, Office Chair | Posted in Shop Work | From the Oct. 2014 issue [retrieved Aug. 23, 2023]. Retrieved from the Internet: <https://grassrootsmotorsports.com/articles/turn-old-car-seat-new-office-chair/>.*

"Convert a Car Seat Into the Coolest Office Chair Ever "—By JT_Makes_It in Workshop, YouTube video uploaded Nov. 25, 2019 [ retrieved Aug. 23, 2023]. Retrieved from the internet: <https://www.instructables.com/Convert-a-Car-Seat-Into-the-Coolest-Office-Chair-E/>.*

Making a Real PC Gaming Chair From Car Seat' by AzooL Dubai, YouTube video uploaded May 28, 2019 [retrieved Aug. 23, 2023]. Retrieved from the Internet: <https://www.youtube.com/watch?v=rr7Wn2TpZnc>.*

"Converting a G06 BMW X6M seat into an office chair!", by Ironically Engineered, YouTube video uploaded Jun. 24, 2022 [retrieved Aug. 23, 2023], Retrieved from the internet. <https://www.youtube.com/watch?v=UOTfb8y40IQ>.*

"DIY Gaming chair form car seat (Mitsubishi Eclipse)" by Side Project, YouTube video uploaded Jan. 13, 2021 [retrieved Aug. 23, 2023 ], Retrieved from the internet. <https://www.youtube.com/watch?v=UdnwJf0F5Ck>.*

(Continued)

*Primary Examiner* — Rodney B White
(74) *Attorney, Agent, or Firm* — Southern Methodist University Dedman School of Law

(57) ABSTRACT

Adapters may be used for connecting pieces of equipment that may not be directly connected. One adapter for a vehicle seat includes two rails and a metal plate connecting the rails. The rails further include a plurality of holes configured to receive two or more fastening bolts. The fastening bolts are configured to couple a vehicle seat to each of the two rails. The metal plate further includes at least one hole configured to receive a chair base protrusion.

14 Claims, 5 Drawing Sheets

(56) References Cited

OTHER PUBLICATIONS

"Making a Real Racing Seat into a Chair!" by Robbie Ferreira, YouTube video uploaded Oct. 30, 2018, [retrieved Aug. 23, 2023], Retrieved from the internet. <https://www.youtube.com/watch?v=9LvXPRuWwsM>.*

"How To Turn Tesla Model 3 Seats into Office Chairs!" by Backshop Electric, YouTube video uploaded Feb. 23, 2021, [retrieved Aug. 23, 2023], Retrieved from the internet. <https://www.youtube.com/watch?v=uXfAjYir7Bc>.*

"DIY Gaming Seat from an Old Car Seat", by Rene GP, YouTube video uploaded May 4, 2023, [retrieved Aug. 23, 2023], Retrieved from the internet. <https://www.youtube.com/watch?v=J6rC4HRdccE>.*

"Converting Car Seat into Comfortable Gaming/Office chair| DIY Office chair||" by Anmol Saini, YouTube video uploaded Jan. 3, 2021, [retrieved Aug. 23, 2023], Retrieved from the internet. <https://www.youtube.com/watch?v=zMf4VEXi99U>.*

"Turning an Old Saab Seat into a Desk Chair!" by Auto Autopsy, YouTube Video uploaded on Jul. 7, 2018 [retrieved on Aug. 23, 2023], Retrieved from the Internet. <https://www.youtube.com/watch?app=desktop&v=cc3NhEV1otE>.*

"1020—Converting a Car Seat Into an Office Chair." by Robert Murray-Smith, YouTube video uploaded on Mar. 5, 2021 [retrieved on Dec. 1, 2023], Retrieved from the internet. <https://www.youtube.com/watch?v=Z8IEGnNBkVw>.*

* cited by examiner

VEHICLE BUCKET SEAT ADAPTER FOR ALTERNATIVE USE/UTILITY

BACKGROUND

A vehicle seat is a seat which is used in automobiles. Vehicle seats are designed to seat one or more than one passenger. A vehicle seat which is designed to seat one person is commonly called a bucket seat. A vehicle seat which is designed to seat more than one person is commonly called a bench seat. An office chair, which is also commonly called a desk chair, is a type of chair that is designed for use, by a single person, at a desk in an office. Many vehicle seats are fastened to the frame of an automobile by four screws. The location within the frames where a fastener may be inserted generally differs between vehicles of different makes. Most office seats are bolted down by four fasteners

SUMMARY

Implementations described herein relate to adapters for automobile seats. The vehicle seat adapter includes a first and second rail, and a metal plate. The first and second rail includes a plurality of holes configured to receive two or more fasteners. Further, the two or more fasteners are configured to couple a vehicle seat to the each one of the first rail and the second rail. The metal plate is connected to and positioned between the first rail and the second rail, and includes at least one hole. Further, the at least one hole becomes fixedly coupled to the chair base when the chair base protrusion is received by the at least one hole of the metal plate.

In some implementations, only one side of the first rail has a slope leading to the mounting brackets and only one side of the second rail has a slope leading to the mounting holes. In various implementations, on the first rail there is more than one slopes with a nonzero angle leading down to the mounting holes and on the second rail there is more than one slopes with a nonzero angle leading down to the mounting holes. In some implementations, the first rail, second rail, and the metal piece form a single body. In various implementations, the first and second rails include an armrest. In some implementations, the armrest includes a body portion and a leg portion. In various implementations, the vehicle seat adapter includes wiring which supports the connection of an external battery to power the mounted seats electrical functions. In some implementations, the vehicle seat adapter includes wiring which may be plugged into an electrical outlet enabling the utilization of the mounted seats electrical functions.

Various implementations relate to a system for adapting a vehicle seat to an office chair base. The system includes an automobile seat configured to seat one or more person. Further, the system includes a vehicle seat adapter. Further, the vehicle seat adapter includes a first and second rail, and a metal plate. Further, the first and second rail includes a plurality of holes configured to receive two or more fastening bolts. Further, the two or more fastening bolts are configured to couple a vehicle seat to the each one of the first rail and the second rail. The metal plate is connected to and positioned between the first rail and the second rail and includes at least one hole. Further, the at least one hole becomes fixedly coupled to the chair base when the chair base protrusion is received by the at least one hole of the metal plate. Further, the system includes an office chair base. Further, the office chair bases include three or more of prongs that are configured to stabilize the office chair base.

Further, the office chair base includes a metal tube that is in the center of the three or more prongs and extends away from the three or more prongs. Further, the metal tube is configured to connect to the vehicle seat adapter. Further, the office chair base is connected to the vehicle seat by the metal tube extending from the office chair base.

In some implementations, the surface of the rails in the vehicle seat system have a non-zero angle that leads to the mounting holes. In various implementations, the surface of the rails in the vehicle seat system are flush with the mounting holes. In some implementations, the vehicle seat adapter includes wiring which supports the connection of an external battery to power the mounted seat electrical functions. In various implementations, the vehicle seat adapter includes wiring which may be plugged into an electrical outlet enabling the utilization of the mounted seats electrical functions.

Some implementations relate to a method for securing a vehicle seat to an adapter. The method includes coupling a vehicle seat adapter to an office chair base. Further, coupling an office chair base to the vehicle seat adapter.

In various implementations, the vehicle seat adapter is coupled to the vehicle seat by a plurality of bolts fastened to the vehicle seats mounting system.

Figure 1:
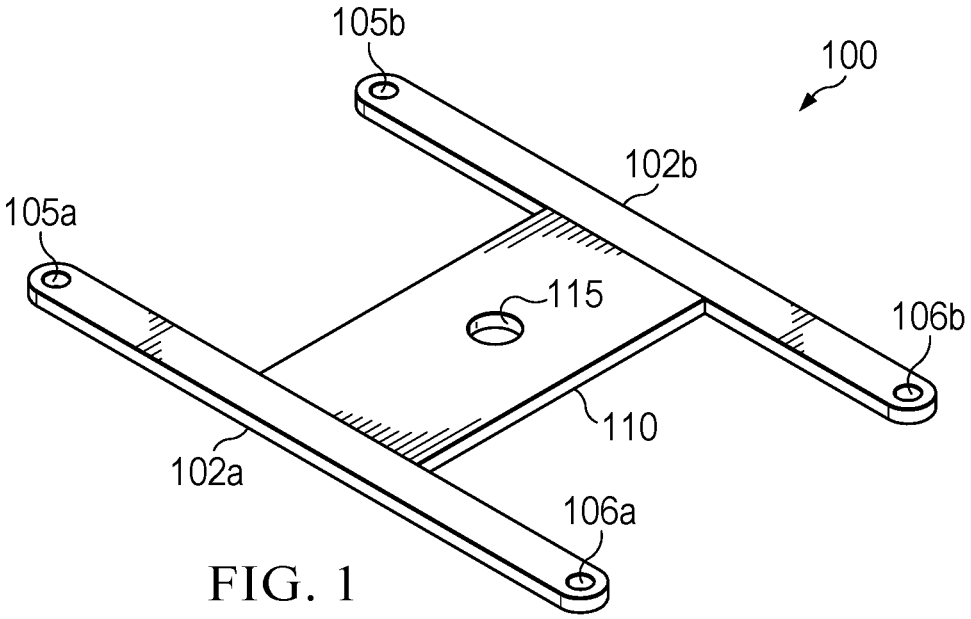
FIG. 1 shows a perspective view of an example embodiment where the rails of the vehicle seat adapter that has no slope leading to the fastening holes, according to an illustrative interpretation.

It will be recognized that some or all the figures are schematic representations for purposes of illustration. The figures are provided for the purpose of illustrating one or more embodiments with the explicit understanding that they will not be used to limit the scope or the meaning of the claims.

DETAILED DESCRIPTION

In general, vehicle seats are fastened to a seat bracket which is similarly bolted to the chassis of a vehicle. The seat bracket is commonly called the runway of a vehicle seat. Some seat brackets may be a single component while others include multiple individual components. Car manufacturers generally design their own seats and brackets which are unique to the manufacturer. Consequently, the point in the frame where a fastener may be inserted varies widely between different vehicles. Aftermarket vehicle seats and brackets are commonly sold for the purpose of installing a different vehicle seat a into vehicle; vehicle seats and brackets that are different from the original equipment manufacturer (hereinafter referred to as "OEM"). The invention disclosed herein may be manufactured to accommodate the specific proportions for both aftermarket and OEM seats and brackets. The accommodation would allow for the overlap of the fastening holes.

Vehicle seats may have electric functions. These seats will contain a motor and in some vehicles the motor is tucked underneath the seat so it is out of sight when riding in an automobile. The motor powers functionalities like seat movement as well as heating and cooling. The functionalities are generally utilized by manipulating a button, lever, or switch. The manipulation sends a signal through wires to the motor which gets its power to perform the function by a vehicles electrical system.

Office chairs are a common item in offices. There are many kinds of office chairs. Some models have wheels that allow for easy transportation of the chair. Other models do not have these wheels because of the increase in stability that may be gained from a less mobile design. For purposes of this disclosure, office chairs may generally be considered to have three structural elements. These elements are the seat, the frame, and the base. The seat is the component of an office chair that someone sits in. The frame is the component that houses the chair and connects to the base. The base is the portion that connects to the ground, and it also houses the frame and chair. These elements of office chairs may vary widely between models and manufacturers.

In some models, it is common to find a central column that extends from the base to the seat. In these models, one end of the central column is received by the base and the other end of the central column is received by of the frame.

Referring generally to the figures, the apparatus, systems, and methods relate to adapting an office chair base, particularly to adapt an office chair base to allow the connection of a different seat, such as an automobile vehicle seat. The object of the invention is to provide a surface to mount a vehicle seat to. It is another object of the invention to provide a similar surface that enables the connection to a portion of an office chair.

Some people may find that the seat in their automobile is quite comfortable to sit in for extended periods of time. Further, in their home or office, these same people may have office chairs which are not comfortable. If these people attempted to install their automobile seats onto their office chairs, they would be unable to do so. The invention at hand provides the means for a solution to those wishing to connect a vehicle seat onto an office chair.

Therefore, aspects of the present disclosure address the problem of incompatibility in connecting an automobile vehicle seat to an office chair by disclosing an adapter that enables the connection of a vehicle seat and an office chair.

In the present specification, an implementation showing a singular component should not be considered limiting; rather, the present disclosure is intended to encompass other implementations including a plurality of the same component, and vice-versa, unless explicitly stated otherwise herein. Moreover, the applicants do not intend for any term in the specification or claims to be ascribed an uncommon or special meaning unless explicitly set forth as such. Further, the present implementations encompass present and future known equivalents to the known components referred to herein by way of illustration. The present implementations will now be described in detail with reference to the drawings, which are provided as illustrative examples of the implementations so as to enable those skilled in the art to practice the implementations and alternatives apparent to those skilled in the art.

Referring now to FIG. 1 in general, the illustration depicts a perspective view of an example embodiment 100 of the vehicle seat adapter. The embodiment 100 includes the first and second rail 102(*a-b*) (hereafter referred to herein as "the rails 102"), which are identical to each other. Although the first and second rail are specifically qualified, either could be the first or the second. In this embodiment, the rails have a uniformly flush surface and contain fastening mounting holes 105(*a-b*). The surface of the rails 102 accommodate the runways of some vehicle seats so they may stack on top of the adapter. The fastening holes 105(*a-b*) and fastening holes 106(*a-b*) are present at both ends of the rails 102. Further, the metal plate 110 couples the rails 102(*a-b*). Further, the metal plate 110 is flush with the rails 102. Additionally, the metal plate 110 contains a hole 115 which supports the intake of a central column from an office chair.

Figure 2:
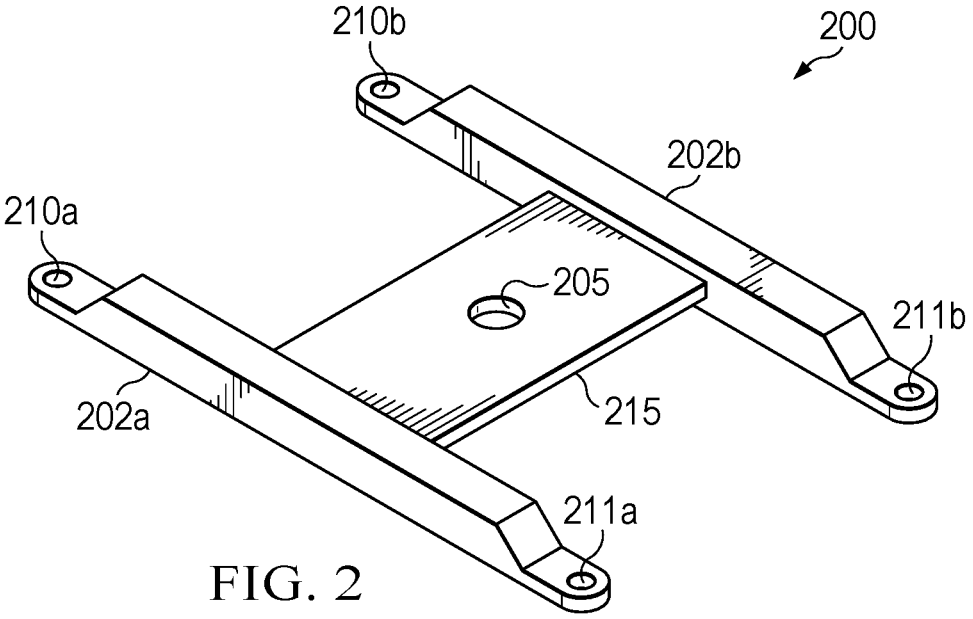
FIG. 2 shows a perspective view of a different example embodiment to that illustrated in FIG. 1, where the vehicle seat adapter contains slope that lead to the fastening holes, according to an illustrative interpretation.

Referring now to FIG. 2 in general, the illustration depicts a perspective view of an example embodiment 200 different to the embodiment depicted in FIG. 1. The embodiment in this figure contains similar features and functions relative to FIG. 1. The embodiment includes the first and second rail 202(*a-b*) (hereafter referred to herein as "the rails 202"), which are identical to each other. Like the embodiment in FIG. 1, the first and second rail are qualified, however, either rail could be the first or second rail. Unlike FIG. 1, this embodiment does not have a flush surface leading to the fastening holes 210(*a-b*) or 211(*a-b*). Instead, each end of each rail of the rails 202 has a slope that leads down to the fastening holes 210(*a-b*) and 211(*a-b*). The rails 202 in this embodiment are designed to couple with vehicle seats with angled runways, that is runways where there is some degree of an angle that leads to the mounting holes. A vehicle seat may be positioned on top of the rails 202 and the metal plate 215, so the mounting holes of both the runway of the vehicle seat and this example embodiment overlap. The position may allow a fastener to be inserted which may then secure the two components together. Additionally, the metal plate 215 couples the rails 202. The metal plate 215 may be welded to the rails 202. Further, the metal plate 215 contains a hole 205 which the central column of an office chair may be inserted through.

Figure 3:
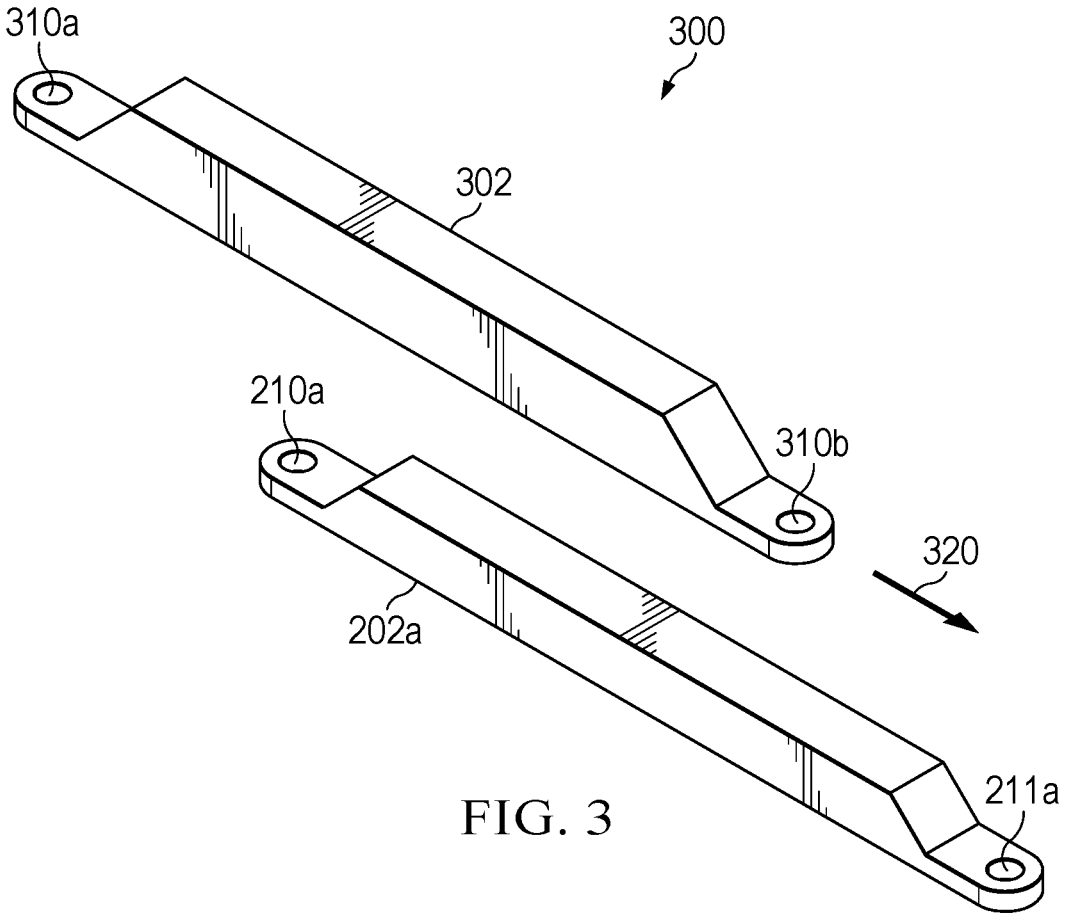
FIG. 3 shows a side view of an example embodiment demonstrating how the vehicle seat is coupled to the adapter, according to an illustrative interpretation.

Referring now to FIG. 3 in general, the illustration depicts the rail 202*a* of the example embodiment in FIG. 2 coupling with an example runway of a vehicle seat 302. It should be noted that there are many different designs of vehicle seat runways. The runway of a vehicle seat (310) contains runway mounting holes 310(*a-b*). In this figure, the runway is positioned on the surface of the embodiment so there is an overlap between the runway mounting holes 310(*a-b*) and the fastening holes 202(*a-b*) of the rail 202*a*. The overlap of the two components creates a passage where a fastener may be inserted through the passage to connect the components.

The direction arrow 320 demonstrates how the runway of the vehicle seat 302 may be positioned to couple with the rail 202*a*.

Figure 4:
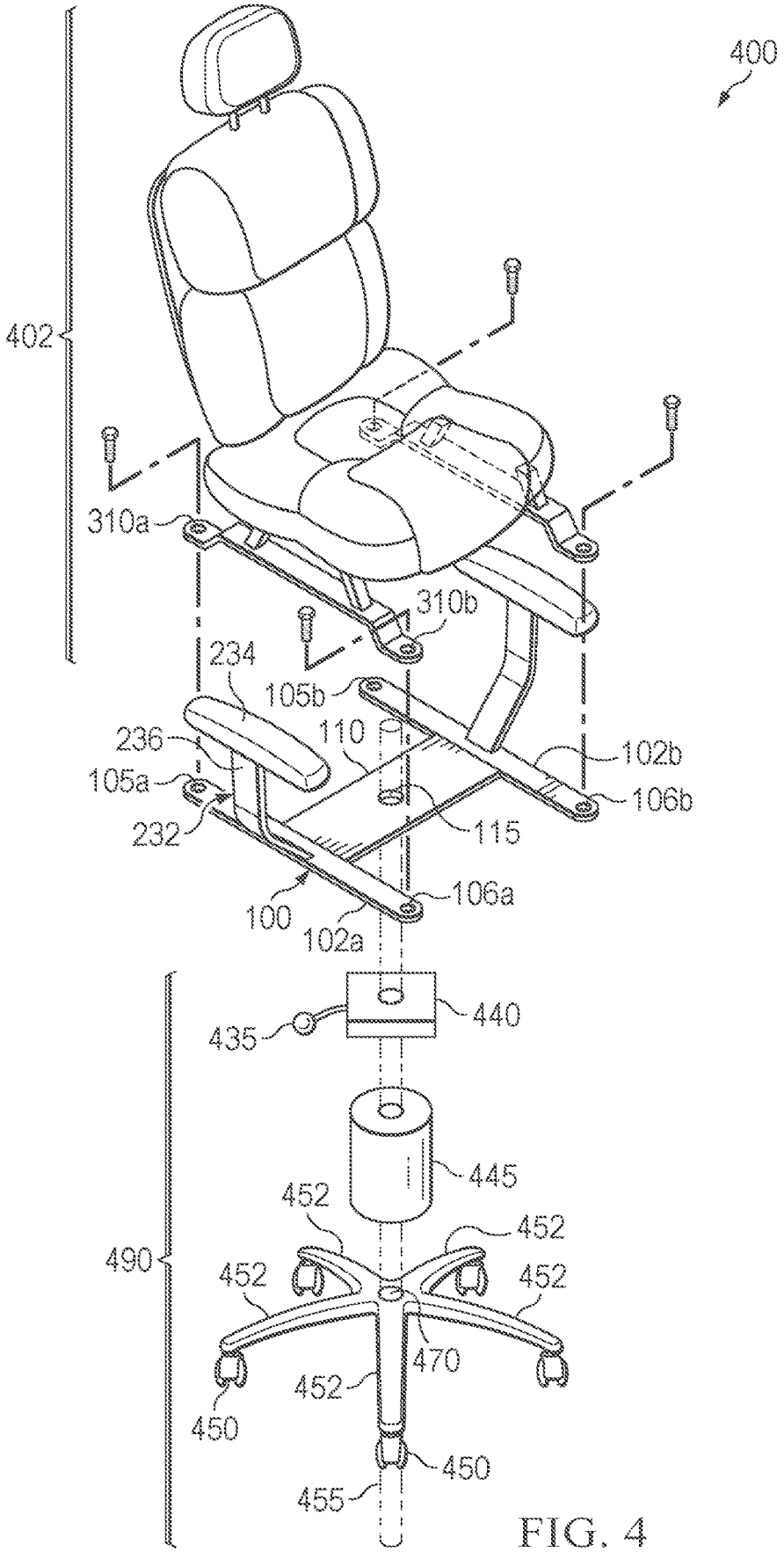
FIG. 4 shows an exploded view of an adapted vehicle seat system implementing the embodiment in FIG. 1 which is coupled to both a vehicle seat and an office chair base and frame, according to an illustrative interpretation.

Referring now to FIG. 4 in general, the illustration depicts an exploded view of an adapted vehicle seat system 400. The system includes a vehicle seat 402, the example embodiment 100 depicted in FIG. 1 and an office chair base and frame 490 (hereinafter referred to as "the chair base 490"). A vehicle seat 402 is positioned on top of the example embodiment 100 where the fastening hole 105 a and the fastening hole 106 a overlap with one side of the runway mounting hole 310 a and runway mounting hole 310 b. Similarly, the other side of the vehicle seat runway is positioned above the 102 b rail so there is an overlap of fastening hole 105 b and fastening hole 106 b. Fasteners are inserted through the overlapping holes to couple the vehicle seat 402 to the example embodiment 100 which then forms an adapted vehicle seat complex. The central column is inserted into the vertical space 455 which further inserts through the holes in the swivel wheel base 470, the pneumatic cylinder 445, chair mechanism 440, and the hole 115 in the metal plate 110. The office chair base and frame 490 contain a pneumatic lever 435, the pneumatic cylinder 445, three or more prongs 452, and the swivel wheels 450. The three or more prongs 452 extend from a center of the swivel wheel base 470. Each prong 452 is coupled to a swivel wheel 450. In aspects, an armrest 232 includes a body portion 234 and a leg portion 236. When the vehicle seat adapter is coupled to a car seat, the armrest are configured to enable a user sitting on the seat to rest a user's arm on the armrest.

Figure 5:
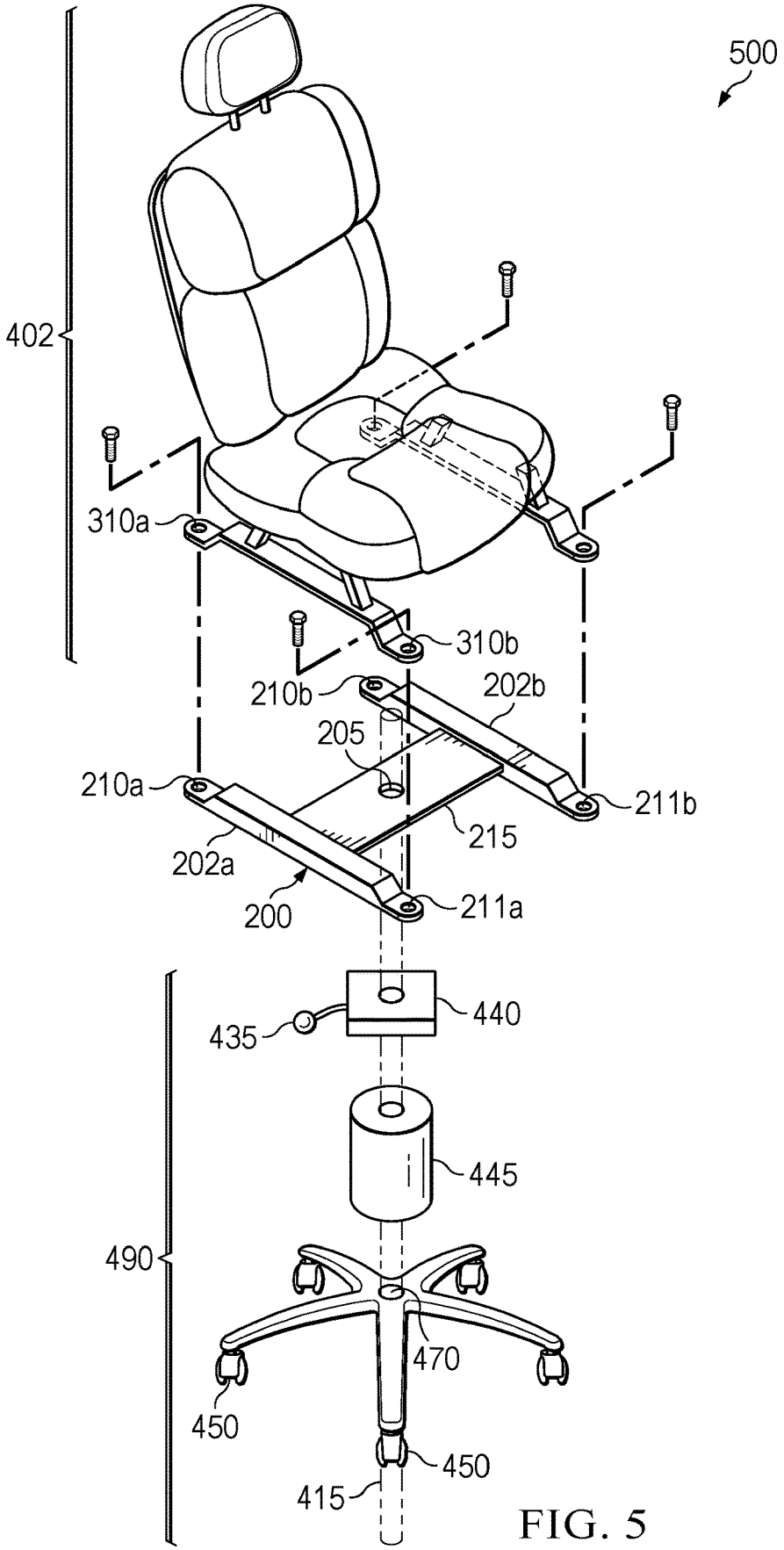
FIG. 5 shows an exploded view of an adapted vehicle seat system implementing the embodiment in FIG. 2 which is coupled to both a vehicle seat and an office chair base and frame, according to an illustrative interpretation.

Referring now to FIG. 5 in general, the illustration depicts an exploded view of an adapted vehicle seat system 500. The system includes a vehicle seat 402, the example embodiment 100 depicted in FIG. 1 and an office chair base and frame 490 (hereinafter referred to as "the chair base 490"). A vehicle seat 402 is positioned on top of the example embodiment 200 where the fastening hole 210*a* and the fastening hole 211*a* overlap with one side of the runway mounting hole 310*a* and runway mounting hole 310*b*. Similarly, the other side of the vehicle seat runway is positioned above the 202*b* rail so there is an overlap of fastening hole 210*b* and fastening hole 211*b*. Fasteners are inserted through the overlapping holes to couple the vehicle seat 402 to the example embodiment 200 which then forms an adapted vehicle seat complex. The central column is inserted into the vertical space 455 which further inserts through the holes in the swivel wheel base 470, the pneumatic cylinder 445, chair mechanism 440, and the hole 205 in the metal plate 215. The office chair base and frame contain a pneumatic lever 435 and the swivel wheels 450.

Figure 6:
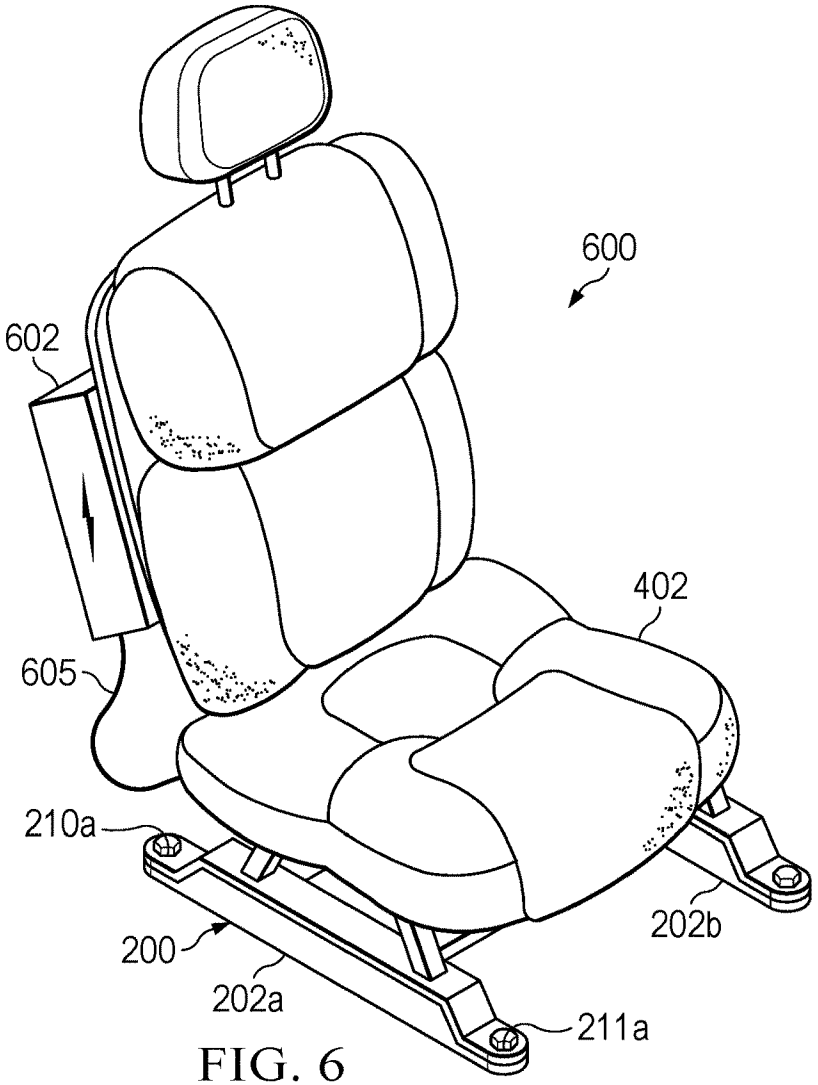
FIG. 6 shows a perspective view of an adapted vehicle seat system implementing the embodiment in FIG. 2 where the vehicle seat adapter is connected to both a vehicle seat and office chair base and frame. The system includes wiring for an external battery pack to provide power for the vehicle seat's electric functions, according to an illustrative interpretation.

Referring now to FIG. 6 in general, the illustration depicts a perspective view of a vehicle seat system 600 implementing an example embodiment. The system in this example includes a vehicle seat 402, an external battery 602, wiring 605, and the example embodiment depicted in FIG. 2. In the illustration, the vehicle seat 402 is fastened to the rails 202(*a-b*) of the embodiment 200 and is fastened to one side of the runway of the vehicle seat 402 with bolts in the fastening hole 210*a* and fastening hole 211*a*. In like fashion, rail 202*b* is fastened to the other side of the vehicle seat runway. An external battery 602 is included which may enable the operation of the seat's electrical functions. The functions may be employed by the manipulation of a button, switch, or lever. The button, switch, or lever, once manipulated, will then send a signal through the wire 605 to the motor located within or around the vehicle seat 402. The motor then performs the functions by utilizing the electrical energy transferred from the external battery pack 602.

Figure 7:
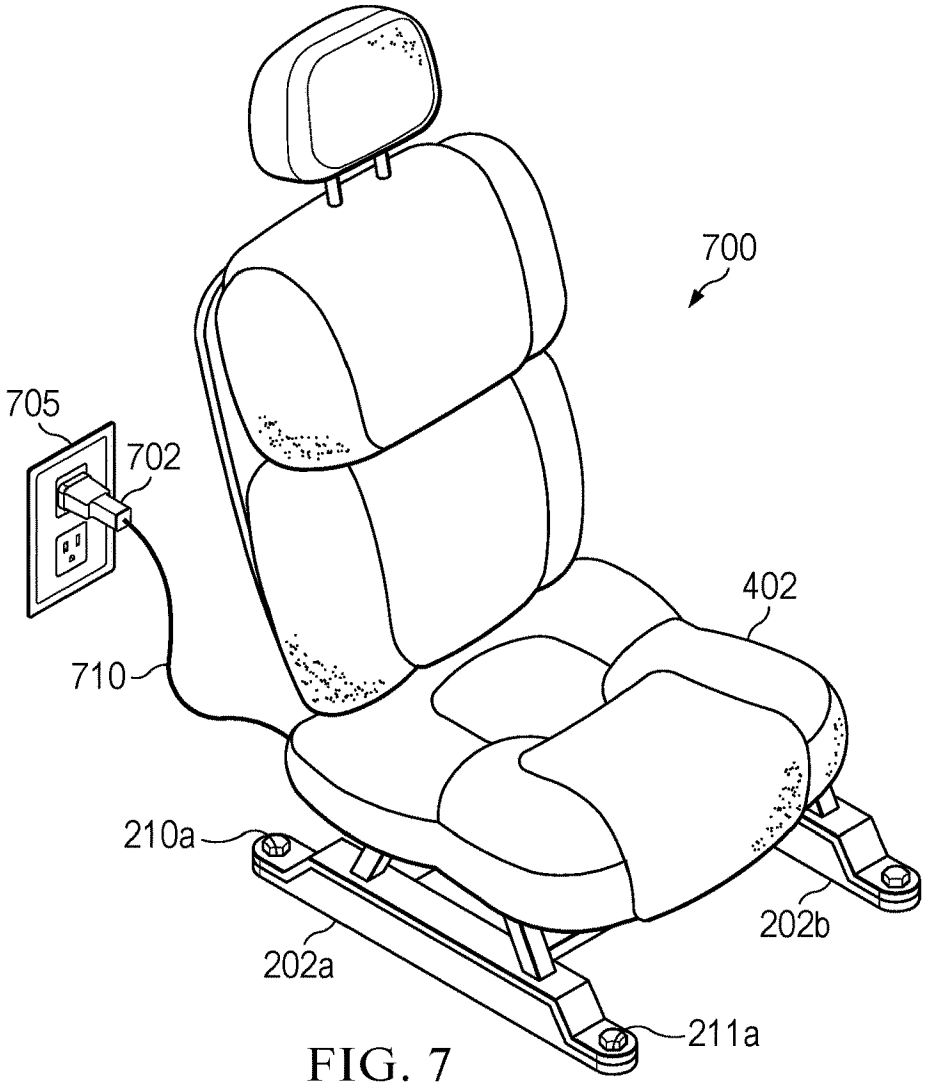
FIG. 7 shows a perspective view of an adapted vehicle seat system implementing the embodiment in FIG. 2 where the vehicle seat adapter is connected to both a vehicle seat and office chair base and frame. The system includes wiring to plug into an electrical outlet to provide power for the vehicle seat's functionality, according to an illustrative interpretation.

Referring now to FIG. 7 in general, the illustration depicts a perspective view of an adapted vehicle seat system 700 implementing an example embodiment. The system in this example includes a vehicle seat 402, an AC power plug 702, an electrical outlet 705, and the example embodiment depicted in FIG. 2. In the illustration, the vehicle seat 402 is fastened to the rails 202(*a-b*) of the embodiment 200. The embodiment 200 is fastened to the runway of the vehicle seat 402 with bolts in the fastening hole 210*a* and fastening hole 211*a*. The rail 202*b* is fastened to the runway of the vehicle seat in likewise fashion. The AC power plug 702 is plugged into an electrical outlet 705 which enables the operation of the vehicle seats electrical functions. The functionalities may be employed by the manipulation of a button, switch, or lever. The button, or switch, or lever, once manipulated, will then send a signal through the wire 710 to the motor located within or around the vehicle seat 402. The motor then performs the functions by utilizing the electrical energy transferred from the electrical outlet 705 which is provided by the AC power plug 702.

What is claimed is:

1. A vehicle seat adapter, comprising: a first rail and a second rail, wherein each one of the first rail and second rail comprises:

a plurality of holes configured to receive a respective fastening bolt, wherein both ends of the first rail and the second rail have slopes that lead down to the plurality of holes and the plurality of holes enable a vehicle seat to be mounted to the first rail and the second rail; and a metal plate connected to and positioned between the first rail and the second rail;

wherein the metal plate comprises at least one hole, the at least one hole configured to receive a chair base protrusion, wherein the metal plate becomes fixedly coupled to the chair base when the chair base protrusion of the chair base is received by the at least one hole of the metal plate.

2. The vehicle seat adapter as set forth in claim 1, wherein the first rail, the second rail, and the metal plate form a single body.

3. The vehicle seat adapter as set forth in claim 1, wherein each rail includes an armrest.

4. The vehicle seat adapter as set forth in claim 1, wherein the vehicle seat adapter includes wiring which supports the connection of an external battery to power the mounted seat's electrical functions.

5. The vehicle seat adapter as set forth in claim 1, wherein the vehicle seat adapter includes wiring which may be plugged into an electrical outlet enabling the utilization of the mounted seat's electrical functions.

6. An adapted vehicle seat system comprising:

an automobile seat configured to seat one or more person; and a vehicle seat adapter comprising:

a first rail and a second rail, wherein each one of the first rail and second rail comprises:

a plurality of holes configured to receive two or more fasteners, wherein the two or more fasteners are configured to couple a vehicle seat to each one of the first rail and the second rail; and wherein a surface of each of the first and second rails has a non-zero angle that leads to the plurality of holes; and a metal plate connected to and positioned between the first rail and the second rail; wherein the metal plate comprises at least one hole, the at least one hole configured to receive a chair base protrusion, wherein the metal plate becomes fixedly coupled to the chair base when the chair base protrusion of the chair base is received by the at least one hole of the metal plate; and an office chair base comprising:

three or more prongs configured to stabilize the office chair base;

a metal tube located in the center of the three or more prongs extending vertically away from the three or more prongs, wherein a metal tube is configured to connect to the vehicle seat adapter;

wherein the office chair base is connected to the vehicle seat adapter by the metal tube extending from the office chair base.

7. The adapted vehicle seat system as set forth in claim 6, wherein the surface of the rails is flush with the fastening holes.

8. The adapted vehicle seat system as set forth in claim 7, wherein the adapter includes wiring which supports the connection of an external battery to power the mounted seat's electrical functions.

9. The adapted vehicle seat system as set forth in claim 7, wherein the vehicle seat adapter includes wiring which may be plugged into an electrical outlet enabling the utilization of the mounted seat's electrical functions.

10. The adapted vehicle seat system as set forth in claim 6, wherein the adapter includes wiring which supports the connection of an external battery to power the mounted seat's electrical functions.

11. The adapted vehicle seat system as set forth in claim 6, wherein the vehicle seat adapter includes wiring which may be plugged into an electrical outlet enabling the utilization of the mounted seat's electrical functions.

12. A vehicle seat adapter, comprising:

a first body defining:

a first rail section and a second rail section, each of the first and second rail sections including a plurality of holes configured to receive two or more fasteners to enable the first and second rail section to be coupled to a vehicle seat; and a plate section defined between the first and second rail sections, the plate section defining at least one hole configured to receive a chair base protrusion; and a first armrest coupled to the first rail section and a second armrest coupled to the second rail section.

13. The vehicle seat adapter of claim 12, wherein the vehicle seat adapter includes wiring which supports the connection of an external battery to power the mounted seat's electrical functions.

14. The vehicle seat adapter as set forth in claim 12, wherein the vehicle seat adapter includes wiring which may be plugged into an electrical outlet enabling the utilization of the mounted seat's electrical functions.

* * * * *